United States Patent [19]

Higashi

[11] Patent Number: 4,928,148

[45] Date of Patent: May 22, 1990

[54] FIXING DEVICE SELECTIVELY OPERABLE IN COLOR OR BLACK/WHITE COPING MODE

[75] Inventor: Yuichirou Higashi, Kagoshima, Japan

[73] Assignee: Ricoh Company, Ltd., Tokyo, Japan

[21] Appl. No.: 416,971

[22] Filed: Oct. 4, 1989

[30] Foreign Application Priority Data

Oct. 6, 1988 [JP] Japan ..... 63-250887
Dec. 8, 1988 [JP] Japan ..... 63-308785

[51] Int. Cl.[5] ..... G03G 15/20

[52] U.S. Cl. ..... 355/290; 219/469; 355/311

[58] Field of Search ..... 355/285, 326, 289, 327, 355/290, 328, 295; 219/10.57, 469, 244

[56] References Cited

U.S. PATENT DOCUMENTS 4,549,803 10/1985 Ohno et al. ..... 219/469 X

FOREIGN PATENT DOCUMENTS 0199372 11/1983 Japan ..... 355/295

OTHER PUBLICATIONS

Stryjerski, W. A., *Research Disclosure,* Sep. 1977, #16122, Compound Roller Contact Fuser Concepts.

*Primary Examiner*—A. T. Grimley
*Assistant Examiner*—John Barlow
*Attorney, Agent, or Firm*—Oblon, Spivak, McClelland, Maier & Neustadt

[57] ABSTRACT

A fixing device for a dry process copier selectively operable in a full-color copy mode and a black-and-white copy mode has a Teflon-coated first fixing roller which is a rigid roller, and a second fixing roller having an elastic layer thereon. In the full-color copy mode the second fixing roller fixes a toner image while, in the black-and-white copy mode, the first fixing roller fixes a toner image. When various units of the copier other than the fixing device are not activated, heat sources individually accommodated in the first and second fixing rollers are activated to warm up the fixing rollers rapidly to a predetermined temperature. While the full-color copy mode or the black-and-white copy mode is under way, either one of the heat sources which is to join in fixation is activated.

5 Claims, 3 Drawing Sheets

FIXING DEVICE SELECTIVELY OPERABLE IN COLOR OR BLACK/WHITE COPING MODE

BACKGROUND OF THE INVENTION

The present invention relates to a fixing device for a dry process copier which is selectively operable in a full-color copy mode and a black-and-white copy mode.

A full-color copier has customarily adopted a procedure wherein an original document is separated in color by blue, green and red filters to form three different electrostatic latent images one after another on a photoconductive element, the individual latent images are developed in colors which are complementary to the colors of the filters, i.e., yellow, magenta and cyan, and the developed images are transferred one upon another to a single paper sheet in register with each other. A problem with this kind of procedure is that when yellow, magenta and cyan toners are simply superposed one upon another, it is difficult to render black and colors in a dark area faithfully due to, among others, spectral reflectance characteristics particular to color toners. To enhance efficient black-and-white mode copying with such a full-color copier, it is extensively practiced to use a black developing unit in addition to yellow, magenta and cyan developing units. Specifically, in a full-color copy mode, the black developing unit develops a latent image which is formed on a photoconductive element by a yellow filter, while the other developing units develops their associated latent images as mentioned above. The resulting yellow, magenta, cyan and black toner images are transferred to a paper sheet one upon another to produce a full-color copy. With this kind of copier, a black-and-white copy which is predominant over a color copy is produced by a single sequence of exposing, developing and transferring steps without using the filters and, therefore, with high efficiency.

A fixing device for a copier having a black-and-white copying capability only and extensively used today has a rigid fixing roller and an elastic roller which is pressed against the fixing roller. The fixing roller is made up of a metal core and a coating of Teflon or similar parting material provided on the core. A heat source is accommodated in the fixing roller. A paper sheet carrying a non-fixed toner image thereon is fed to a nipping section which is defined between the fixing roller and the elastic roller, whereby the toner image is firmly fixed on the paper sheet by heat. This type of fixing device using heat is operable over a long time and with high reliability. When it comes to a full-color copier of the above-described type, however, the surface property and parting ability particular to Teflon is not sufficient to eliminate offsets, jams and irregular images because the toner layer will be composed of yellow, magenta and cyan toners with or without a black toner. With a color copier operable in a full-color copy mode only, it is known that quality images are attainable by implementing a fixing roller as a roller which is coated with silicon rubber or similar elastic material, pressing a rigid roller against the fixing roller, and causing an image surface of a paper sheet into contact with the surface of the roller coated with an elastic material.

The toner layer is thicker in a full-color copy mode than in a black-and-white copy mode. Hence, full-color copying needs two or three times greater amount of heat than black-and-white copying for the fixation of a toner image on a paper sheet. In the light of this, a heat source is sometimes disposed not only in a fixing roller but also in a pressing roller. However, since a copier is powered by an ordinary commercial power source, it is necessary that the total power consumption of a copier be less than 100 volts and 15 amperes, i.e., the wattage allocated to a heat source cannot be increased beyond a certain limit. Some approaches may be contemplated for increasing the amount of heat to be applied to a paper sheet and a toner while maintaining the capacity of a heat source constant: (a) elevating the fixing temperature, (b) increasing the nipping width, and (c) lowering the linear speed. However, the approach (a) is apt to cause silicon oil or similar parting agent applied to the roller surface to fume smoke or cause the temperature inside the machine to elevate, bringing about adverse influences and even dangerous conditions. The approach (b) cannot provide a twice or three times greater nipping width than in a black-and-white copy mode, unless the pressure exerted by the pressing roller is increased. The approach (c) which lowers the linear speed and thereby increases the passing time of a paper sheet through a nipping section is most practical and easy.

A fixing device to which the present invention pertains is a heat roller type fixing device for a dry process copier which is selectively operable in a black-and-white copy mode and a full-color mode. This kind of fixing device, therefore, has to have a long life, not to speak of the ability to desirably fix both a black-and-white copy and a full-color copy. The fixing device using a fixing roller coated with an elastic material and feasible for full-color copies only is not sufficient in the service life aspect and not cost-effective for a copier which is mostly used to produce black-and-white copies. It is necessary that the amount of heat to be applied to a paper sheet and a toner at the time of fixation be switched to an optimum value which differs from black-and-white copying to full-color copying. When such a changeover is effected by changing the nipping width, an arrangement for changing the pressing force will become disproportionately complicated and bulky.

SUMMARY OF THE INVENTION

It is therefore an object of the present invention to provide a fixing device for a dry process copier having a black-and-white and a full-color copying capability which insures high quality reproduction for both of the two different kinds of copying and has a long service life despite the predominant black-and-white copying operations.

It is another object of the present invention to provide a fixing device for a dry process copier which activates a plurality of heat sources efficiently within a range available with a commercial power source so as to warm up fixing rollers rapidly.

A fixing device for a dry process copier selectively operable in a black-and-white copy mode which uses a black toner, and a full-color copy mode which transfers color-separated images one upon another to a paper sheet of the present invention comprises a first fixing roller comprising a rigid roller and having a heat source therein, a second fixing roller coated with an elastic layer and having a heat source therein, the second fixing roller being pressed against the first fixing roller to rotate, in a pressing portion, in the same direction and at the same linear speed as the first pressing roller, a pressing roller coated with an elastic layer and pressed against the first fixing roller to rotate, in a pressing portion, in the same direction and at the same linear speed as the first fixing roller, a guide movable between a first position for guiding a paper sheet fed from an image transfer station to a first nipping section which is defined between the first fixing roller and the pressing roller such that an image surface of the paper sheet contacts the first fixing roller, and a second position for guiding the paper sheet to a second nipping section defined between the first fixing roller and the second fixing roller such that the image surface contacts the second fixing roller, a driver for selectively rotating the first fixing roller in opposite directions, and a controller for controlling the first fixing roller and driver such that in the full-color copy mode the guide assumes the second position and the first fixing roller is rotated in a direction for transporting the paper sheet in a predetermined direction in the second nipping section while, in a black-and-white copy mode, the guide assumes the first position and the first fixing roller is rotated in a direction for transporting the paper sheet in the predetermined direction in the first nipping section.

BRIEF DESCRIPTION OF THE DRAWINGS

The above and other objects, features and advantages of the present invention will become more apparent from the following detailed description taken with the accompanying drawings in which:.

DESCRIPTION OF THE PREFERRED EMBODIMENTS

Figure 1:
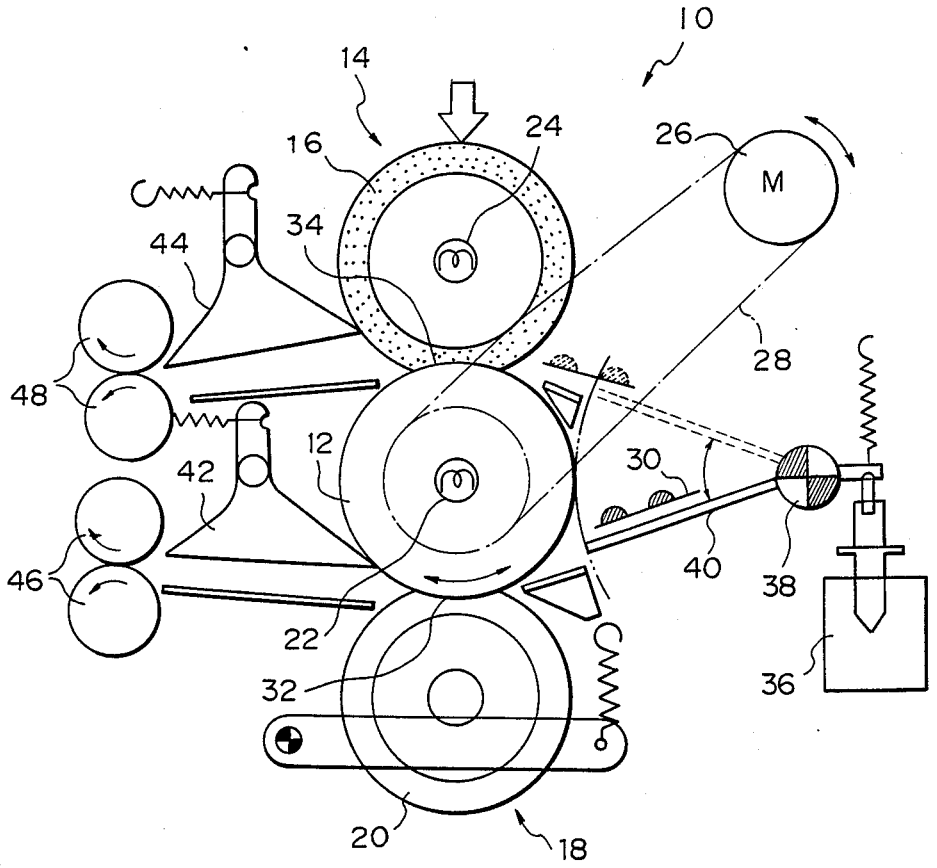
FIG. 1 is a section of a fixing device for a dry process copier embodiment the present invention.

Referring to FIG. 1 of the drawings, a fixing device embodying the present invention is shown and generally designated by the reference numeral 10. As shown, the fixing device 10 has a first fixing roller 12, a second fixing roller 14 constantly urged against the top of the first roller 12 by a spring, not shown, and a pressing roller 18 constantly pressed against the bottom of the first roller 12 by a spring and a lever. The first fixing roller 12 is made up of a metal core and a thin layer (less than 500 microns) of Teflon or similar parting material provided on the metal core. The second fixing roller 14 has a layer 16 of silicon rubber or similar elastic material thereon. The pressing roller 18 also has a layer 20 of silicon rubber or similar elastic material thereon. Heat sources in the form of heaters 22 and 24 are accommodated in the fixing rollers 12 and 14, respectively. The fixing roller 12 is rotatably supported by bearings, not shown, which are individually affixed to opposite side walls of the fixing device 10. A reversible motor 26 is drivably connected to the fixing roller 12 by a chain 28 in order to selectively drive it in opposite directions.

A paper sheet 30 carrying a non-fixed toner image thereon is transported into the fixing device 10 from the right-hand side as viewed in FIG. 1. An inlet guide 40 is located at the inlet of the fixing device 10 on the transport path and rotatable between a first and a second position which are indicated by a solid and a phantom line, respectively. In the first position, the inlet guide 40 guides the paper 30 to a first nipping section 32 which is defined between the first fixing roller 12 and the pressing roller 18. In the second position, the inlet guide 40 steers the paper sheet 30 to a second nipping section 34 defined between the first and second fixing rollers 12 and 14. The inlet guide 40 is driven by a solenoid to move between such two positions about a fulcrum 38.

Separator pawls 42 and 44 are located at the outside side of the first and second nipping sections 32 and 34, respectively. The tips of the pawls 42 and 44 are held in contact with the first and second fixing rollers 12 and 14, respectively. Discharge roller pairs 46 and 48 are positioned at the outlet side of the pawls 42 and 44, respectively. Thermistors, not shown, are individually associated with the first and second fixing rollers 12 and 14 so as to control the associated heaters 22 and 24 on the off, whereby the rollers 12 and 14 are maintained at a predetermined fixing temperature.

Figure 2:
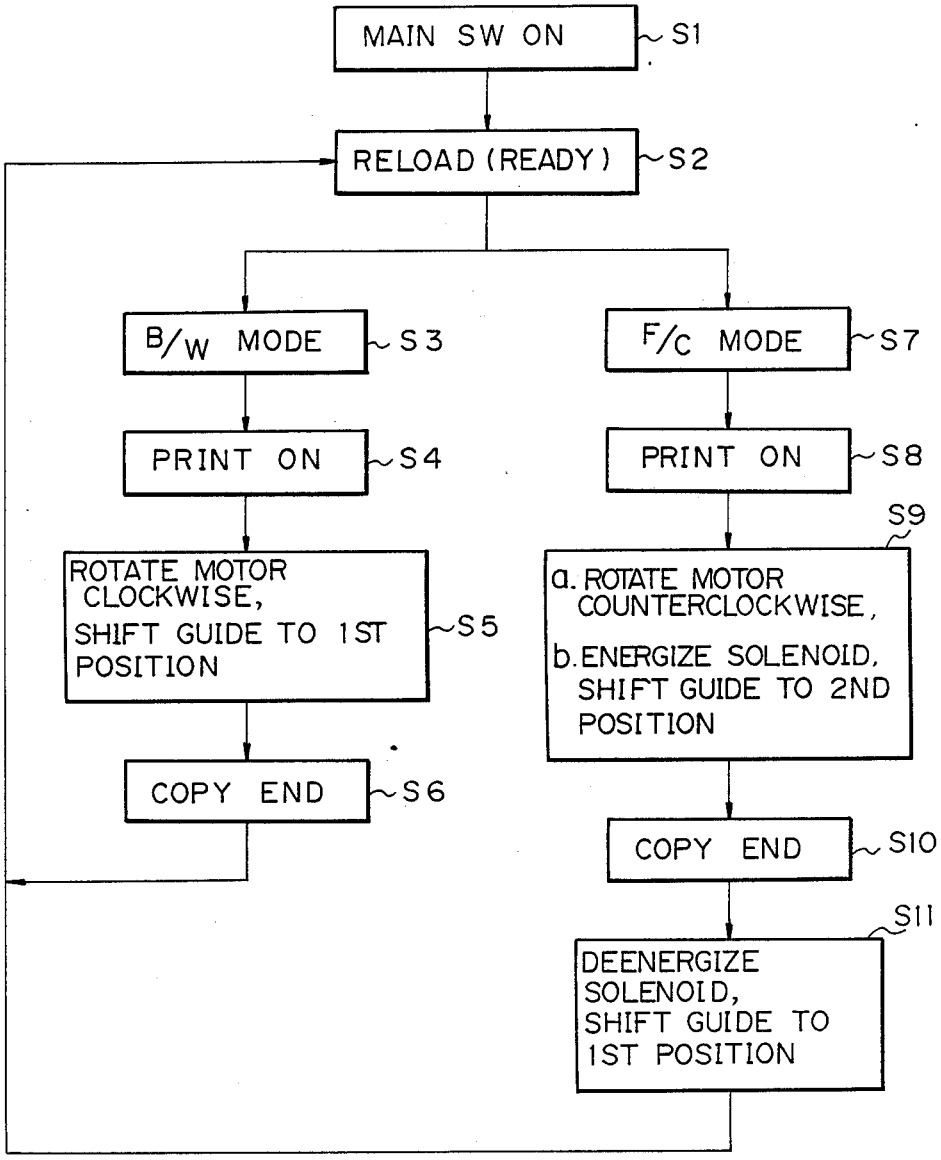
FIG. 2 is a flowchart demonstrating the operation of the illustrative embodiment.

The operation of the fixing device 10 having the above construction will be described with reference to FIG. 2.

After a main switch has been turned on (step S1), a reload state or ready state is reached (step S2). Assume that a black-and-white (B/W) copy mode is selected (step S3). Then, when a print switch is pressed (step S4), the motor 26 is driven in a clockwise direction (step S5). The solenoid 36 is not energized so that the inlet guide 40 remains in the first position. In this condition, the paper sheet 30 carrying a black toner image thereon and fed from an imagewise transfer station, not shown, is driven into the first nipping section 32 which is defined by the first fixing roller 12 rotating clockwise and the pressing roller 18 being rotated by the roller 12. The toner image on the paper sheet 30 is brought into contact with the Teflon-coated first fixing roller 12 and thereby fixed in the same manner as in a prior art black-and-white copier. The paper sheet 30 coming out of the nipping section 32 is separated from the fixing roller 12 by the separator pawl 48 and driven out of the copier to a copy tray by the discharge roller pair 46. On the completion of a copying procedure (step S6), the copier is restored to the reload state.

On the other hand, when a full-color (F/C) copy mode is selected (step S7), the motor 26 begins to rotate counterclockwise as soon as the print switch is turned on (step S8). At the same time, the solenoid 36 is energized to shift the inlet guide 40 to the second position as indicated by a phantom line in FIG. 1 (step S9). If desired, the program may be modified such that the start of rotation of the motor 26 and the energization of the solenoid 36 occur before the turn-on of the print switch. The paper sheet 30 fed from the transfer station and carrying, in this case, a composite color image formed by toners of different colors is guided by the inlet guide 40 to the second nipping section 34 which is defined by the first fixing roller 12 rotating counterclockwise and the second fixing roller 14 being rotated by the roller 12. Thereafter, the paper sheet 30 is transported with its surface carrying the image contacting the surface of the silicon rubber layer of the fixing roller 14, as in a fixing device of a prior art full-color copier. The toner image is fixed on the paper sheet 30 by the coactive fixing rollers 12 and 14 which are heated to a predetermined temperature by the heaters 22 and 24, respectively. The paper sheet 30 coming out of the second nipping section 34 is separated from the fixing roller 14 by the separator pawl 44 and driven out of the copier by the discharge roller pair 48. As the copying operation ends (step S10), the solenoid 36 is deenergized to return the inlet guide 40 to the first position (step S11).

As stated above, in a black-and-white copy mode which is predominant over a full-color copy mode, a toner image is fixed by the first fixing roller 12 which is implemented as a Teflon-coated rigid roller. This guarantees a long service life and high reliability. On the other hand, in a full-color copy mode, a toner image is fixed by the second fixing roller 16 which has an elastic layer thereon. This insures high picture quality and eliminates offsets, jams, etc. The full-color copy mode is far lower in frequency than the black-and-white mode and, therefore, has little influence on the service life.

In the illustrative embodiment, the roller 12 intervening between the rollers 14 and 18 is implemented as a rigid roller, journalled to opposite side walls of the fixing device 10, and driven by the motor 26. The other rollers 14 and 18 each having an elastic layer thereon are pressed against and driven by the intermediate roller 12. Such a construction is successful in maintaining the linear speed in each of the two nipping sections 32 and 34 constant, thereby preventing the image quality from being degraded.

While the rollers 14 an 18 have been shown and described as being driven by the roller 12 in pressing contact with the latter, the drive may be implemented by a gearing, i.e., a gear mounted on a shaft of the roller 12 and gears individually mounted on the rollers 14 and 18 and meshing with the gear of the roller 12. The reversible motor 26 for driving the rollers 12, 14 amd 18 may be replaced with a motor which is rotatable in one direction only, in which case the transmission mechanism will be provided with a reversible clutch.

An alternative embodiment of the present invention will be described which substitutes a variable speed motor for the reversible motor 26 shown in FIG. 1. The variable speed motor is controlled to rotate at a lower speed in a full-color copy mode than in a black-and-white copy mode, as will be described.

Figure 3:
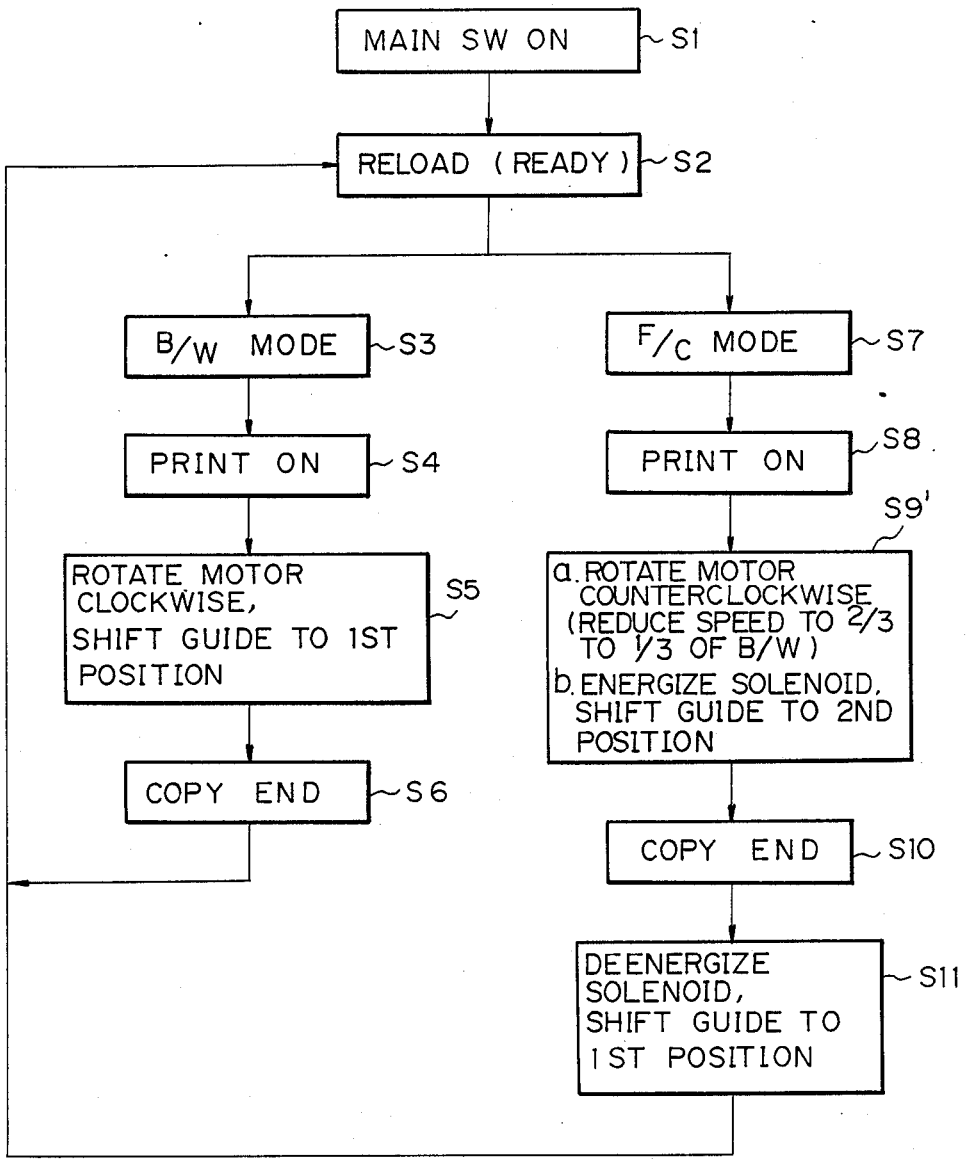
FIG. 3 is a flowchart representative of an alternative embodiment of the present invention.

The alternative embodiment is essentially similar to the previous embodiment except for the rotation speed in a full-color copy mode which is preferably selected to be two-thirds to one-third of the rotation speed assigned to a black-and-white mode. FIG. 3 is a flowchart demonstrating the operation of the alternative embodiment and which is the same as the operation shown in FIG. 2 except for a step S9'. Specifically, when a full-color copy mode is selected, not only the motor 26 is rotated counterclockwise (step S9, FIG. 2) but also its rotation speed is reduced to two-thirds to one-third of the black-and-white mode (step S9').

As previously discussed, since a toner layer is thicker in a full-color copy mode than in a black-and-white copy mode, a full-color copy mode needs a twice to three times greater amount of heat than a black-and-white copy mode for the fixation of a toner image on a paper sheet. While the capacity of the heat source accommodated in the second fixing roller may be increased to implement such an amount of heat, a problem is that the total amount of current available with a copier cannot exceed 100 volts and 15 amperes, as stated previously. With the alternative embodiment which slows down the rotation of the fixing rollers in a full-color copy mode, it is easy to double or triple the period of time necessary for a paper sheet to pass the nipping section and, therefore, to increase the amount of fixing heat accordingly.

For color copying, blue, green and red filters for color separation are selectively positioned on an optical path at the time of imagewise exposure. Hence, it is impracticable to obtain a necessary amount of exposure by using the same scanning rate (equal to the linear speed of a photoconductive element) as a black-and-white copy mode while combining the filters with a specific spectral sensitivity characteristic of the photoconductive element. It has been customary with a copier having a full-color and a black-and-white reproduction capability to use an ND (Neutral Density) filter or a stop in a black-white copy mode, while maintaining the linear velocity of a photoconductive element constant. A copier recently put on the market has an imaging unit whose processing speed is variable and, in a black-and-white copy mode, lowers the linear speed of a photoconductive element to thereby increase the copying rate (c.p.m). In this type of copier, the transport speed in the fixing device which is lower in a full-color copy mode than in a black-and-white copy mode as stated previously will advantageously match the transport speed in the imaging unit. Even with a copier whose imaging section is not variable in processing speed, the alternative embodiment is practicable only if a space is defined between the image transferring section and the fixing section for accommodating a bend of a paper sheet which will occur due to the difference in transport speed between the imaging section and the fixing section.

In any of the embodiments shown and described, the fixing rollers 12 and 14 are respectively heated by the heaters 22 and 24 which are installed therein. The heaters 22 and 24 consume substantial power, and compared to other components of the copier. Since a majority of copiers is placed in locations where only an ordinary commercial power source for home as used (100 V, 15 A) is available, how to select the capacity of the two heaters 22 and 24 within an allowable range available with the commercial power source is an important issue.

In the embodiments, considering the power of the commercial power source which is 100 volts and 15 amperes (=1.5 kilowatts), 900 watts and 600 watts are allocated to the heaters 22 and 24, respectively. When the power switch of the copier is turned on to cause the fixing rollers 12 and 14 to warm up to the predetermined temperature or when the copier is not performing a copying cycle (standby condition), both the heaters 22 and 24 are turned on. This allows the rollers 12 and 14 to be heated to the predetermined temperature within a short period of time.

While a copying operation is under way either in a black-and-white copy mode or in a full-color copy mode, not only the fixing device but also other various units operate and, hence, it is not allowable to allocate 900+600=1500 watts to the heaters 22 and 24. In a black-and-white copy mode, therefore, only the heater 22 which acts on a paper sheet is turned on while the other heater 24 is turned off. Conversely, in a full-color mode, only the heater 24 is turned on while the heater 22 is turned off. In this manner, while a copying operation is under way in a black-and-white mode or in a full-color mode, the total power consumption of the copier does not exceed 1.5 kilowatts despite the activation of the other units.

The allocation of 900 watts to the heater 22 and 600 watts to the heater 24 stated above stems from an assumption that the copying rate of the illustrative embodiments is 20 c.p.m in a black-and-white copy mode and 5 c.p.m in a full-color copy mode. However, such an allocation is not limitative and is open to choice.

In summary, the present invention provides a fixing device for a dry process copier which produces black-and-white and full-color copies stably with a relatively simple construction and has a substantial service life. A first fixing roller which is rigid is journalled to opposite side walls of the fixing device while elastic rollers are pressed against the first roller to be driven thereby. Such a configuration insures constant linear speed in a stable manner and thereby enhances high-quality image reproduction. The paper transport speed may be lowered in a full-color copy mode, compared to a black-and-white copy mode, so as to increase the amount of fixing heat to a desired value. Further, when a plurality of heat sources are accommodated in the fixing device, the fixing rollers can be warmed up to a predetermined temperature within a short period of time by efficient use of a commercial power source.

Various modifications will become possible for those skilled in the art after receiving the teachings of the present disclosure without departing from the scope thereof.

What is claimed is:

1. A fixing device for a dry process copier selectively operable in a black-and-white copy mode which uses a black toner, and a full-color copy mode which transfers color-separated images one upon another to a paper sheet, comprising:

a first fixing roller comprising a rigid roller and having a heat source in said first fixing roller;

a second fixing roller coated with an elastic layer and having a heat source in said second fixing roller, said second fixing roller being pressed against said first fixing roller to rotate, in a pressing portion, in a same direction and at a same linear speed as said first pressing roller;

a pressing roller coated with an elastic layer and pressed against said first fixing roller to rotate, in a pressing portion, in a same direction and at a same linear speed as said first fixing roller;

guide means movable between a first position for guiding a paper sheet fed from an image transfer station to a first nipping section which is defined between said first fixing roller and said pressing roller such that an image surface of said paper sheet contacts said first fixing roller, and a second position for guiding said paper sheet to a second nipping section defined between said first fixing roller and said second fixing roller such that said image surface contacts said second fixing roller;

drive means for selectively rotating said first fixing roller in opposite directions; and control means for controlling said first fixing roller and said drive means such that in the full-color copy mode said guide means assumes the second position and said first fixing roller is rotated in a direction for transporting the paper sheet in a predetermined direction in said second nipping section while, in a black-and-white copy mode, said guide means assumes the first position and said first fixing roller is rotated in a direction for transporting said paper sheet in said predetermined direction in said first nipping section.

2. A fixing device as claimed in claim 1, wherein said first fixing roller is rotatably supported by bearings which are individually affixed to opposite side walls, said second fixing roller and said pressing roller being rotated by said first fixing roller.

3. A fixing device as claimed in claim 1, wherein said first fixing roller, said second fixing roller and said pressing roller are each rotatable at a variable speed.

4. A fixing device as claimed in claim 1, wherein a sum of power consumed by said heat sources accommodated in said first fixing roller and said second fixing roller is substantially equal to power available with a commercial power source.

5. A fixing device as claimed in claim 4, wherein said control means further controls said heat sources accommodated in said first fixing roller and said second fixing roller such that when said first fixing roller and said second fixing roller are to be warmed up to a predetermined temperature and when the copier is in a standby condition without performing a copying operation, both of said heat sources accommodated in said first fixing roller and said second fixing roller are activated, in the black-and-white copy mode only said heat source accommodated in said first fixing roller is activated, and in the full-color copy mode only said heat source accommodated in said second fixing roller is activated.

* * * * *